US005133376A

United States Patent [19]

Samarin et al.

[11] Patent Number: 5,133,376

[45] Date of Patent: Jul. 28, 1992

[54] DEVICE FOR ULTRASONIC MACHINING OR ARTICLES IN LIQUID MEDIUM

[76] Inventors: Igor A. Samarin, ulitsa Asanalieva, 36, korpus 1, kv. 134; Mikhail D. Tyavlovsky, ulitsa Chicherina, 4, KV. 15, both of Minsk, U.S.S.R.

[21] Appl. No.: 635,556

[22] PCT Filed: May 17, 1989

[86] PCT No.: PCT/SU89/00121

§ 371 Date: Jan. 15, 1991

§ 102(e) Date: Jan. 15, 1991

[87] PCT Pub. No.: WO90/14175

PCT Pub. Date: Nov. 29, 1990

[51] Int. Cl.[5] ..... B08B 3/12

[52] U.S. Cl. ..... 134/184; 68/3 SS; 310/348

[58] Field of Search ..... 68/3 SS; 134/184, 56 R, 134/58 R, 902; 366/127; 310/365, 348

[56] References Cited

U.S. PATENT DOCUMENTS

| | | | |
|---|---|---|---|
| 2,904,981 | 9/1959 | Macomson | 68/3 SS |
| 3,185,446 | 5/1965 | Blanchard | 68/3 SS |
| 3,371,233 | 2/1968 | Cook | 134/184 X |
| 3,640,295 | 2/1972 | Peterson | 134/184 X |
| 4,311,157 | 1/1982 | Jubenville . | |
| 4,391,672 | 7/1983 | Lehtinen | 68/3 SS |

FOREIGN PATENT DOCUMENTS

| | | |
|---|---|---|
| 3638140 | 5/1988 | Fed. Rep. of Germany . |
| 262529 | 5/1970 | U.S.S.R. . |
| 460074 | 7/1975 | U.S.S.R. . |
| 558722 | 7/1977 | U.S.S.R. . |
| 925437 | 5/1982 | U.S.S.R. . |

*Primary Examiner*—Frankie L. Stinson
*Attorney, Agent, or Firm*—Lilling and Lilling

[57] ABSTRACT

The device for ultrasonic machining of articles in a liquid medium comprises two groups (2, 3) of acoustical-electrical transducers (4) arranged on an elastic element (7), filled with a liquid medium (8), in staggered order at a predetermined distance from articles being machined. The acoustical-electrical transducers (4) of the group (2) are connected to the output of an ultrasonic generator (1). The acoustical-electrical transducers (4) of the group (3) are connected to the output of the ultrasonic generator (1) through a phase-pulse modulator (5) connected to a saw-tooth voltage generator (6).

1 Claim, 1 Drawing Sheet

DEVICE FOR ULTRASONIC MACHINING OR ARTICLES IN LIQUID MEDIUM

TECHNICAL FIELD

The present invention relates to devices for transmitting ultrasonic mechanical oscillations to a liquid medium and in particular to devices for ultrasonic machining of articles in a liquid medium.

BACKGROUND ART

A known device for ultrasonic machining of articles in a liquid medium comprises an ultrasonic generator, which is connected directly to two groups of acoustical-electrical transducers arranged on an elastic element at a predetermined distance from articles machines in a liquid medium so that the acoustical-electrical transducers of one group are disposed between the acoustical-electrical transducers of the other group (cf. SU, A, 262,529).

In the afore-mentioned device, immediate connection of the ultrasonic generator to both groups of acoustical-electrical transducers results in a condition when ultrasonic machining of articles is affected by maximum and minimum values of acoustical pressure on articles in a liquid medium due to interference of ultrasonic oscillations set up in said liquid medium by both groups of acoustical-electrical transducers. Consequently, there are stagnation regions and regions marked by an elevated acoustical pressure, a disadvantage resulting in nonuniform machining of articles due to which machining quality is impaired.

There is also known a device for ultrasonic machining of articles in a liquid medium, which comprises an ultrasonic generator and two groups of acoustical-electrical transducers, one of said groups being directly connected to the output of said ultrasonic generator, while the other group is electrically coupled to said output. Both groups are placed on an elastic element, filled with a liquid medium, at a predetermined distance from articles machined in said liquid medium so that the acoustical-electrical transducers of one group are disposed between the acoustical-electrical transducers of the other group (cf. SU, A, 460,0741).

In the foregoing device, the ultrasonic generator is electrically connected to one of the groups of acoustical-electrical transducers through a phase shifter. By aligning the phase shifter it is, therefore, possible to ensure uniform machining of articles. However, such machining will be unilateral and restricted to a given article.

The known device has been generally unsatisfactory due to the fact that it is not capable of providing quality two-side machining of large-size flat articles such, for example, as printed circuit boards or magnetic memory disks.

Moreover, the phase shifter has to be additionally aligned to suit the shape of particular articles being machined.

Thus, the known device fails to provide a uniform effect of ultrasonic oscillations on the entire surface of an article being machined and, consequently, does not ensure uniform two-side machining of articles of various shapes, including large-size articles, a disadvantage resulting in low machining quality.

DISCLOSURE OF THE INVENTION

The object of the present invention is to create a device for ultrasonic machining of articles in a liquid medium, in which acoustical-electrical transducers would be electrically connected to an ultrasonic generator so as ensure uniform action of ultrasonic oscillations on the entire surface of articles, including large-size articles.

There is provided a device for ultrasonic machining of articles in a liquid medium, comprising an ultrasonic generator and two groups of acoustical-electrical transducers, one of said groups being connected directly to the output of said ultrasonic generator, while the other group is electrically coupled to said output, both groups being arranged on an elastic element, filled with a liquid medium, at a predetermined distance from articles machined in said liquid medium so that the acoustical-electrical transducers of one group are disposed between the acoustical-electrical transducers of the other group, which, according to the invention, includes such series-connected components as a saw-tooth voltage generator and a phase-pulse modulator, electrical connection of one of the groups of said acoustical-electrical transducers with the ultrasonic generator being accomplished through said phase-pulse modulator.

In the device for ultrasonic machining of articles in a liquid medium according to the invention, provision of a saw-tooth generator and a phase-pulse modulator, their electrical interconnection and electrical coupling of one of the groups of said acoustical-electrical transducers with the ultrasonic generator through said phase-pulse modulator make it possible to prevent stationary character of distribution of maximum and minimum flexural oscillations on the radiating surface of the elastic element, an advantage resulting in a more uniform effect of ultrasonic oscillations on the entire surface of articles being machined. A more uniform effect of ultrasonic oscillations precludes destruction of portions of articles and ensures the absence of unmachined portions thereof whereby quality of machining articles in a liquid medium will be appreciably improved.

Moreover, the machining time is reduced twice due to simultaneous two-side machining of articles.

BRIEF DESCRIPTION OF THE DRAWINGS

The invention will now be described further with reference to a specific embodiment thereof, taken in conjunction with the accompanying drawings, wherein.

BEST MODE OF CARRYING OUT THE INVENTION

Figure 2:
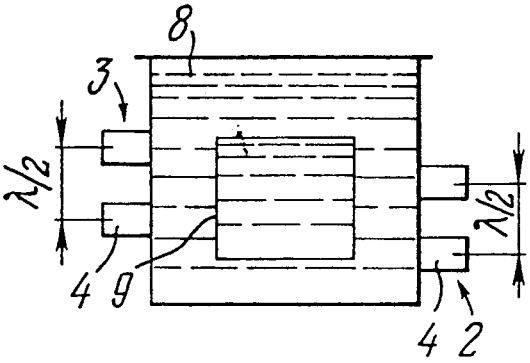
FIG. 2 is a view along arrow A of FIG. 1.

The device for ultrasonic machining of articles in a liquid medium in compliance with the present invention comprises an ultrasonic generator 1 (FIG. 1) and two groups 2 and 3 of acoustical-electrical transducers 4. The group 2 of the acoustical-electrical transducers 4 is directly connected to the output of the generator 1. The group 3 of the acoustical-electrical transducers 4 is electrically coupled to the output of the generator 1 through a phase-pulse modulator 5 connected to the output of a saw-tooth voltage generator 6.

Figure 1:
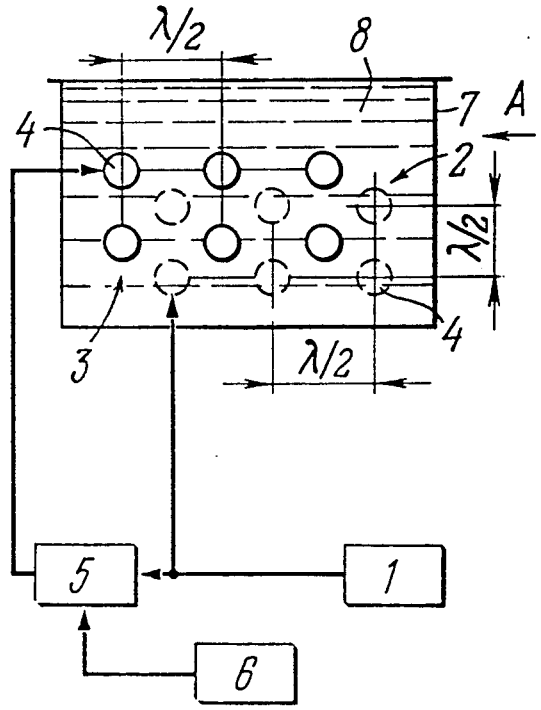
FIG. 1 is a schematic diagram of a device for ultrasonic machining of articles in a liquid medium according to the invention with a front view of an elastic element comprised in the device.

Both groups 2 and 3 of the acoustical-electrical transducers 4 are arranged on an elastic element 7 representing a bath at a predetermined distance from articles 9 (FIG. 2) machined in a liquid medium 8 so that the acoustical-electrical transducers 4 of one group 2 are disposed between the acoustical-electrical transducers 4 of the other group 3, as shown in FIG. 1.

In the preferred embodiment of the invention the acoustical-electrical transducers 4 are magnetostrictive of piezoceramic ultrasonic transducers.

In each group 2 and 3, the acoustical-electrical transducers 4 (FIGS. 1 and 2) are arranged in rows and displaced with respect to one another by a value equal to half a wavelength $\lambda/2$ of ultrasonic oscillations in the liquid medium 8.

In the device forming the subject of the present invention, the groups 2 (FIG. 1) and 3 of the acoustical-electrical transducers 4 are arranged on opposite walls of the bath so that the acoustical-electrical transducers 4 of the groups 2 and 3 are, as a whole, arranged in staggered order, the displacement being equal to a quarter wavelength $\lambda/4$ of ultrasonic oscillations in the liquid medium 8.

To enable better understanding of the features of the invention, the acoustical-electrical transducers 4 of the group 2 are shown with a dashed line in FIG. 1.

In the preferred embodiment of the invention the saw-tooth voltage generator 6 and the phase-pulse modulator 5 may be a saw-tooth voltage generator and a phase-pulse modulator (cr. Titse U. et al "Poluprovodnikovaya skhematekhnika", 1982, Mir publishers, Moscow) widely known to those skilled in the art and suitable for attaining the objects of the present invention.

The device for ultrasonic machining of articles in a liquid medium according to the invention operates in the following manner.

The ultrasonic generator 1 (FIG. 1) generates voltage changing sinusoidally at a frequency equal to the operating frequency of the acoustical-electrical transducers 4. This voltage is fed directly to the acoustical-electrical transducers 4 of the group 2, causing their excitation at natural frequency, which results in occurrence of ultrasonic oscillations in the liquid medium 8.

At the same time, the voltage at an ultrasonic frequency is applied from the output of the ultrasonic generator 1 to one of the inputs of the phase-pulse modulator 5, its other input receiving saw-tooth voltage from the output of the saw-tooth voltage generator 6. The phase-modulated ultrasonic voltage is fed from the output of the phase-pulse modulator 5 to the group 3 of the acoustical-electrical transducers 4.

Figure 3:
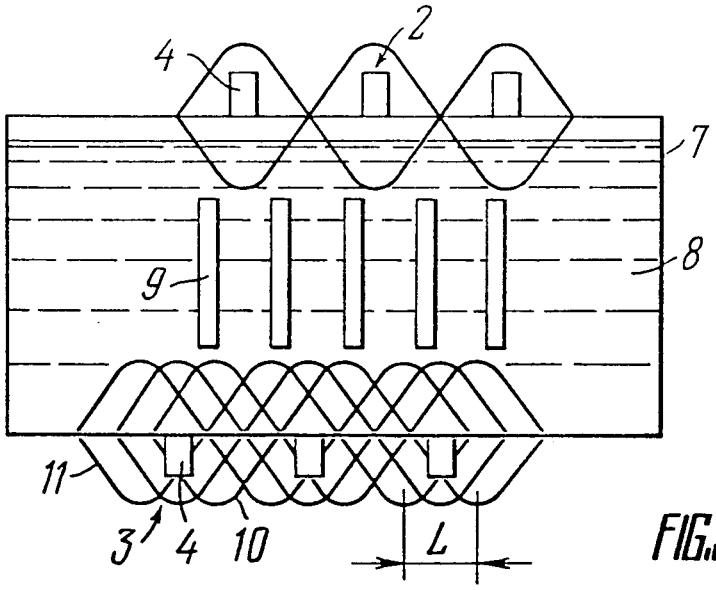
FIG. 3 shows the elastic element of the device of FIG. 1 (top view to an enlarged scale) and gives a plot illustrating distribution of amplitudes of oscillations of said elastic element.

The amplitude of drifts of oscillations of the radiating surface of the elastic element 7 (FIG. 3), set up by the group 3 of the acoustical-electrical transducers 4, varies sinusoidally at ultrasonic frequency $\omega$ and with a phase, which also varies sinusoidally at modulation frequency $\Omega$. The distribution of the drifts is of nonstationary character, its shift on the radiating surface of the elastic element 7 being from the position marked with a curve 10 to the position marked with a curve 11 by an amount L and back, as shown in FIG. 3.

Owing to superposition of oscillations set up by the groups 2 and 3 of the acoustical-electrical transducers 4 in the liquid medium 8, no interference occurs since the oscillations have different phases. Consequently, there will be no stagnation regions on the surfaces of the articles 9 being machined, a feature making more uniform the machining of the entire surface of articles on both sides.

The device for ultrasonic machining of articles in a liquid medium according to the invention ensures high uniformity in simultaneous machining of the entire surface of articles regardless of their shape without additional alignment of an ultrasonic generator after changing a liquid medium or when articles of a different shape are to be machined.

INDUSTRIAL APPLICABILITY

The invention may be used to advantage in ultrasonic machining of articles in a liquid medium in the course of their scouring, degreasing, emulsification, impregnation and etching.

We claim:

1. A device for ultrasonic machining of articles in a liquid medium, comprising an ultrasonic generator and two groups of acoustical-electrical transducers, one of said groups being directly connected to an output of the ultrasonic generator, while the other group is electrically coupled to said output, both groups being arranged on an elastic element, filled with a liquid medium at a predetermined distance from articles machined in the liquid medium so that acoustical-electrical transducers of one group are disposed between acoustical-electrical transducers of the other group, characterized in that it includes such series-connected components as a sawtooth voltage generator and a phase-pulse modulator, electrical connection of one of the groups of the acoustical-electrical transducers with the ultrasonic generator being accomplished through the phase-pulse modulator.

* * * * *